US008378275B2

(12) United States Patent
Novak

(10) Patent No.: US 8,378,275 B2
(45) Date of Patent: Feb. 19, 2013

(54) METHOD AND APPARATUS FOR MICROWAVE-BASED LIQUID VAPORIZATION SYSTEM

(76) Inventor: John F. Novak, Fredericktown, OH (US)

( * ) Notice: Subject to any disclaimer, the term of this patent is extended or adjusted under 35 U.S.C. 154(b) by 87 days.

(21) Appl. No.: 12/962,407

(22) Filed: Dec. 7, 2010

(65) Prior Publication Data

US 2011/0132902 A1 Jun. 9, 2011

Related U.S. Application Data

(60) Provisional application No. 61/267,255, filed on Dec. 7, 2009.

(51) Int. Cl.
*H05B 6/80* (2006.01)
*H05B 6/70* (2006.01)
*H05B 6/50* (2006.01)

(52) U.S. Cl. ..... 219/687; 219/690; 219/696; 219/709

(58) Field of Classification Search ..... 219/687, 219/693, 762, 695, 696, 709, 679, 690, 737
See application file for complete search history.

(56) References Cited

U.S. PATENT DOCUMENTS 5,304,962 A * 4/1994 Bobadilla et al. ..... 333/134
5,536,477 A * 7/1996 Cha et al. ..... 422/171
5,823,676 A * 10/1998 Khijniak et al. ..... 366/348
6,618,957 B2 * 9/2003 Novak et al. ..... 34/264
6,864,757 B2 * 3/2005 du Toit et al. ..... 333/34
7,133,584 B2 * 11/2006 Dawes ..... 385/14
2007/0102279 A1 * 5/2007 Novak ..... 204/157.6
2008/0277388 A1 * 11/2008 Carr ..... 219/693

OTHER PUBLICATIONS

International Search Report dated Feb. 11, 2001, for corresponding application PCT/US2010/059312.
Written Opinion dated Feb. 11, 2001, for corresponding application PCT/US2010/059312.
International Preliminary Report on Patentability dated Jun. 12, 2012, for corresponding application PCT/US2010/059312.

* cited by examiner

*Primary Examiner* — Tu B Hoang
*Assistant Examiner* — Hemant Mathew
(74) *Attorney, Agent, or Firm* — Hahn Loeser & Parks LLP

(57) ABSTRACT

The invention described herein generally pertains to coupling microwave energy into a tuned multi-section WR-975 waveguide assembly, connected to a waveguide containing a ceramic cylindrical applicator, terminated in a dummy load, for pre-heating fuels to improve vaporization, combustion efficiency, and soot reduction in combustion chamber(s). Designed primarily for processing liquid byproducts produced during biodiesel fuel manufacturing, this invention establishes a charge density in a cross-coupled applicator, according to the applicator's volume, dielectric characteristics of the materials being processed, applied frequency, and voltage. This invention may also be used for preheating or polarization of solids within a pipe-conveyed slurry, such as biosolids, bituminous coal, crude oil sludge, paper pulp or shale oil rock. Finally, this invention may serve as an integral part of a coal gasification process, employing both microwave drying and reduction methods, to produce syngas, hydrogen, and/or liquid fuels.

17 Claims, 10 Drawing Sheets

METHOD AND APPARATUS FOR MICROWAVE-BASED LIQUID VAPORIZATION SYSTEM

CROSS-REFERENCE TO RELATED APPLICATIONS

The invention claims priority to and fully incorporates by reference, previously filed provisional patent application 61/267,255 filed on 7 Dec. 2009.

TECHNICAL FIELD

This invention relates generally to a method and apparatus for improving fuel vaporization combustion efficiency, and soot reduction in combustion chamber(s); i.e., boilers, internal combustion engines, and gas turbines, through the coupling of high power density microwave energy into a tuned waveguide assembly, connected to a waveguide containing a ceramic cylindrical applicator.

BACKGROUND OF THE INVENTION

The biodiesel fuel is a mixture of saturated and unsaturated carboxylic acids, along with glycerol, methanol, and water, as a result of the transesterification of animal or vegetable fats, utilizing potassium hydroxide as a catalyst. In addition, some of the potassium hydroxide is carried over into the biodiesel fuel. The biodiesel fuel is decanted and filtered from the byproducts and is in itself characteristic of a typical No. 2 diesel fuel. However, the remaining byproducts from the manufacturing process have sufficient heat value to warrant further processing for their use as a liquid fuel.

Although the byproduct mixture is combustible, it produces the following undesirable results if directly injected into a combustion chamber including:

(a) surface pitting caused by the potassium hydroxide component in the biodiesel byproducts creating surface pitting due to potassium deposition on components exposed to combustion temperatures;

(b) engine fouling and erratic combustion caused by the presence of palmitic acid in the fuel feedstock, due to its exceptionally high boiling point, resulting in incomplete combustion and soot formation; and (c) wax buildup on components exposed to combustion temperatures, due to the presence of palmitic acid, with its exceptionally high boiling point.

SUMMARY OF THE INVENTION

In accordance with one aspect of the invention, there is provided a method and apparatus for improving fuel vaporization combustion efficiency, and soot reduction in combustion chamber(s); i.e., boilers, internal combustion engines, and gas turbines, through the coupling of high power density microwave energy into a bifurcated waveguide assembly, connected to a waveguide containing a ceramic cylindrical applicator.

In one aspect of the invention, an apparatus is described which includes: at least one microwave generator; at least one generally rectangular waveguide having a standing wave of approximately 915 MHz therein generated by the microwave generator; and an essentially transparent ceramic tube having an inlet and an outlet, the ceramic tube positioned at least partially within said waveguide and exposed to the standing wave. In one embodiment, the rectangular waveguide further includes two essentially parallel segments with a first and a second end, and one base segment connecting each of the second ends of the parallel segments to each other. In this configuration, the ceramic tube is positioned at least partially within each of the two essentially parallel segments of said waveguide. In another embodiment, the waveguide includes at least two generally U-shaped rectangular waveguides in spaced apart vertical relationship, the ceramic tube positioned at least partially within each pair of the two essentially parallel segments of the waveguides. In one aspect of the invention, the inlet of a ceramic tube enters proximate one end of one of the parallel segments of a first waveguide and exits through one other end of the other parallel segment of the second rectangular waveguide.

In yet another embodiment, the inlet of the ceramic tube follows the following path: enters proximate a second end of the first waveguide and extends through the parallel segment and exits a first end of the parallel segment; enters the first end of an opposed parallel segment of the first waveguide and extends through the opposed parallel segment and exits proximate the second end of the first waveguide; enters proximate a second end of the second waveguide and extends through the parallel segment and exits a first end of the parallel segment; enters the first end of an opposed parallel segment of the second waveguide and extends through the opposed parallel segment and exits proximate the second end of the second waveguide.

In still yet another embodiment, the microwave apparatus further includes a microwave frequency adjustment means to adjust the microwave frequency. This adjustment means may be a microwave tuner, preferably a 3-stage tuner assembly to match output impedance of a microwave generator to a material flowing through the ceramic tubes. Most preferably, the 3-stage tuner comprises a one wavelength long waveguide section and three brass tuning screws, each brass tuning screw separated by a distance of ⅛ wavelength.

The ceramic tube is constructed from the group consisting of alumina and zirconia, more preferably alumina, most preferably 99.8% alumina.

The invention also includes a process to excite organic material comprising the steps of: creating a standing wave within at least one essentially rectangular waveguide; pumping said material through at least one essentially transparent ceramic tube which extends at least partially into the at least one essentially rectangular waveguide; exposing the material to microwave radiation; and collecting by-products created therefrom.

The process also includes the step of: tuning the standing wave to match the impedance of said material flowing through the ceramic tubes. This tuning may be manual or automatic and employ a 3-stage tuner comprising a one wavelength long waveguide section and three tuning screws, each tuning screw separated by a distance of ⅛ wavelength.

The process includes the step of creating the standing wave in two separate waveguides, each of the waveguides having at least one ceramic tube at least partially embedded therethrough. The frequency of the standing wave is approximately 915 MHz. The organic material may be used non-exclusively for preheating slurries, as a part of a coal gasification process, or to reduce heavy crude oil to a lowered viscosity crude oil comprising fuel oil and diesel oil.

In one aspect, the process includes creating two standing waves within two essentially rectangular U-shaped waveguides; pumping said material through at least one essentially transparent ceramic tube which extends at least partially into each of the essentially parallel sides of the rectangular waveguides; exposing the material to microwave radiation; and collecting by-products created therefrom. In a preferred embodiment, the step of pumping results in travel of the organic material within the ceramic tubes and through both pairs of essentially parallel sides of the rectangular waveguides.

One optional aspect of the process includes power density monitoring within each microwave generator to monitor the applied power to an applicator and the reflected power from said applicator by a pair of sampling diodes installed within a directional coupler mounted in the waveguide.

These and other objects of this invention will be evident when viewed in light of the drawings, detailed description, and appended claims.

DETAILED DESCRIPTION OF THE DRAWINGS

Figure 1:
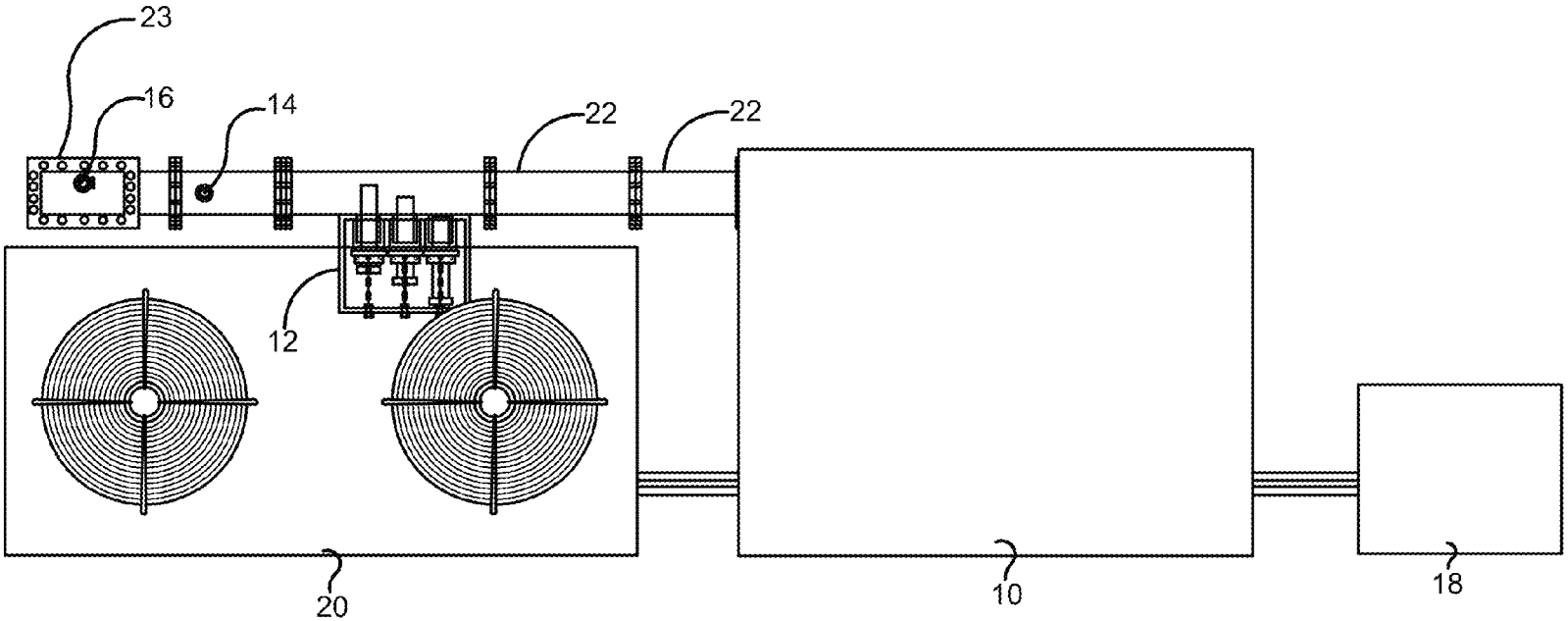
FIG. 1 is a top plan view of a microwave-based fuel vaporization system.

Referring now to the drawings wherein the showings are for purposes of illustrating the preferred embodiment of the invention only and not for purposes of limiting the same, the Figures show both single-fed and dual-fed microwave-based liquid fuel vaporization systems.

The invention described herein generally pertains to a method and apparatus for improving fuel vaporization combustion efficiency, and soot reduction in combustion chamber (s); i.e., boilers, internal combustion engines, and gas turbines, through the coupling of high power density microwave energy into a tuned waveguide assembly, connected to a WR-975 waveguide containing a zirconia cylindrical applicator. The fuel vaporization is accomplished through establishment of a charge density in the cross-coupled applicator consistent with the applicator's volume, dielectric characteristics of the materials being processed, applied frequency, and applied voltage. In a second embodiment, this invention may also be used for preheating or polarization of solids within a slurry, conveyed through a pipe, such as biosolids, coal, paper pulp, or shale oil rock to enhance the efficiency of a drying process through molecular misalignment of the constituent's dipoles. In a third embodiment, this invention may serve as an integral part of a coal gasification process, employing both microwave and reduction methods to produce a high-Btu syngas with properties similar to natural gas, hydrogen with catalytic enhancement, and/or liquid fuels, including diesel, gas oil, and fuel oil. Finally, in a fourth embodiment, this invention may also be used for reduction of heavy crude oil, crude storage tank sludge or oil tanker bottoms through applied high density microwave energy and its subsequent heating effects due to molecular misalignment of the constituent's dipoles, enhanced conductivity due to the presence of salts, and high charge density at particle interfaces.

The biodiesel fuel is a mixture of saturated and unsaturated carboxylic acids, along with glycerol, methanol, and water, as a result of the transesterification of animal or vegetable fats, utilizing potassium hydroxide as a catalyst. In addition, some of the potassium hydroxide is carried over into the biodiesel fuel. The biodiesel fuel is decanted and filtered from the byproducts and is in itself characteristic of a typical No. 2 diesel fuel. However, the remaining byproducts from the manufacturing process have sufficient heat value to warrant further processing for their use as a liquid fuel. Although the byproduct mixture is combustible, it produces the following undesirable results if directly injected into a combustion chamber:

(a) surface pitting caused by the potassium hydroxide component in the biodiesel byproducts creating surface pitting due to potassium deposition on components exposed to combustion temperatures;

(b) engine fouling and erratic combustion caused by the presence of palmitic acid in the fuel feedstock, due to its exceptionally high boiling point, resulting in incomplete combustion and soot formation; and (c) wax buildup on components exposed to combustion temperatures, due to the presence of palmitic acid, with its exceptionally high boiling point.

The microwave-based fuel vaporization system would be used to preheat a glycerol-based fuel feedstock to an appropriate vapor temperature, and through the large difference in boiling points, effect the removal of the corrosive potassium hydroxide and palmitic acid to:

(a) improve combustion efficiency in the prime mover by reducing heat losses due to poor fuel vaporization in the combustion chamber(s) and; and (b) reduce soot and wax building on those components exposed to combustion temperatures, leading to reduced maintenance and downtime.

A simplified mixture of glycerol, methanol, stearic acid, potassium hydroxide and water was used for testing to approximate the characteristics of the byproduct mixture reaction to applied microwave energy. The contributing effects of the remaining carboxylic acids were considered negligible for this test. It was expected that elimination of the potassium hydroxide would occur, with its inherently high boiling point (2421° F.), coupled with some of the stearic acid, with its high boiling point (450° F.), into the gas/liquid condensate trap. An analysis of the test mixture and material properties is given below in the following Tables.

TABLE I

| Mixture Component | Weight % |
|---|---|
| Stearic Acid | 44 |
| Glycerol | 35 |

TABLE I-continued

| Mixture Component | Weight % |
|---|---|
| Methanol | 15 |
| Water | 5 |
| KOH | 1 |
| Total | 100 |

TABLE II

| Physical Parameter | Value |
|---|---|
| Molecular Weight | 163.11 |
| Permittivity, $\epsilon$: | 29.72 |
| Specific Heat, $c_p$, Btu/lb-° F.: | 0.5352 |
| Density, Liquid, $\rho$, lb/gal: | 8.486 |
| Density, Vapor, $\rho$, lb/ft$^3$: | 63.48 |
| Melting Point, ° F.: | 71.30 |
| Boiling Point, ° F.: | 424.64 |
| Heat of Vaporization, Btu/lb | 190.30 |
| Heat of Combustion, Btu/lb.: | 10,674 |

A typical gravimetric analysis of the biodiesel liquid byproduct mixture, along with the material properties relative to utilization of the microwave-based process, are provided below.

TABLE III

| Common Name | CAS Reg. Name | CAS Reg. # | Chemical Formula | M.W. |
|---|---|---|---|---|
| Methyl Alcohol | Methanol | 67-56-1 | $CH_4O$ | 32.04 |
| Glycerol | 1,2,3-Propanetriol | 56-81-5 | $C_3H_8O_3$ | 92.09 |
| Palmitic Acid | Hexadecanoic Acid | 57-10-3 | $C_{16}H_{32}O_2$ | 256.43 |
| Linolenic Acid | 9,12,15-Octadecatrienoic Acid | 463-40-1 | $C_{18}H_{30}O_2$ | 278.44 |
| Linoleic Acid | 9,12-Octadecadienoic Acid | 60-33-3 | $C_{18}H_{32}O_2$ | 280.45 |
| Oleic Acid | 9-Octadecenoic Acid | 112-80-1 | $C_{18}H_{34}O_2$ | 282.47 |
| Stearic Acid | Octadecanoic Acid | 57-11-4 | $C_{18}H_{36}O_2$ | 284.48 |
| Potassium Hydroxide | Potassium Hydroxide | 1310-58-3 | KOH | 56.105 |
| Water | Water | 7732-18-5 | $H_2O$ | 18.015 |
| Nitrogen | Nitrogen | 7727-370-9 | $N_2$ | 28.013 |

TABLE IV

| Common Name | Percent (wt.) | Melting Point ($t_{mp}$) ° F. | Density $\rho_{liq}$ (liquid), lb/gal | Permittivity, $\epsilon$ (liquid) (dimensionless) | Specific Heat $c_p$, (liquid) Btu/lb-° F. |
|---|---|---|---|---|---|
| Methyl Alcohol | 10-20 | −97.60 | 6.59 | 33.0 | 0.609 |
| Glycerol | 30-40 | 64.76 | 10.50 | 46.5 | 0.715 |
| Palmitic Acid | 3-4 | 145.60 | 7.10 | 2.42 | 0.652 |
| Linolenic Acid | 1-2 | 12.20 | 7.63 | 2.83 | 0.465 |
| Linoleic Acid | 12-15 | 445.10 | 7.52 | 3.10 | 0.533 |
| Oleic Acid | 6-8 | 546.80 | 7.44 | 2.34 | 0.489 |
| Stearic Acid | 1-2 | 155.84 | 7.75 | 2.31 | 0.549 |
| Potassium Hydroxide | 1-3 | 762.80 | N/A | N/A | N/A |
| Water | 1-5 | 32.00 | 8.33 | 80.10 | 1.000 |
| Nitrogen | 10-15 | N/A | N/A | N/A | N/A |

TABLE V

| Common Name | Boiling Point ($t_{bp}$) ° F. | Density $\rho_{liq}$ (gas), 68° F. (lb/ft$^3$) | Specific Gravity (dimensionless) | Heat of Combustion, $\Delta H_c$, Btu/lb | Heat of Vaporization, $\Delta H_v$, Btu/lb |
|---|---|---|---|---|---|
| Methyl Alcohol | 148.3 | 0.0832 | 1.1061 | 8,563.2 | 0.00000 |
| Glycerol | 554.0 | 0.2390 | 3.1792 | 6,896.2 | 305.101 |
| Palmitic Acid | 664.7 | 0.6656 | 8.8528 | 15,552.5 | 117.289 |
| Linolenic Acid | 447.8 | 0.7227 | 9.6126 | 15,872.2 | 119.328 |
| Linoleic Acid | 445.1 | 0.7279 | 9.6820 | 15,945.7 | 120.947 |
| Oleic Acid | 546.8 | 0.7332 | 9.7519 | 16,019.2 | 122.444 |
| Stearic Acid | 450.0 | 0.7384 | 9.8212 | 15,854.3 | 118.362 |
| Potassium Hydroxide | 2420.6 | N/A | N/A | N/A | N/A |
| Water | 212.0 | 0.0468 | 0.6219 | 0.00000 | 629.431 |
| Nitrogen | N/A | N/A | 0.9671 | 0.00000 | 0.00000 |

It is noted that the Biofuel Byproduct Mixture storage temperature must be maintained at 151° F. (66.11° C.) to prevent separation/solidification of individual compounds. The microwave process operating temperature (output) is 565° F. (296.11° C.). Due to the heat of vaporization, a ceramic pipe (e.g., zirconia or alumina) with an O.D. of nominal 2.5", I.D. equal to 2.000" (0.1667 ft) by 64.000" (5.33 ft) long, and with a flow of 100 gallons per hour (1.667 gpm), the output pressure will be approximately 140 psig. $V=0.7854\ D^2\ L$. Since $V=ft^3$, all dimensions are in inches and converted to feet.

In a second embodiment, it has been determined that low percentage solids, typically less than 5%, in a water slurry, conveyed through a pipe exposed to microwave energy become polarized, apparently through attempted alignment of their dipoles with the applied electric field, which manifests itself as heat, resulting in a more efficient downstream drying process. This phenomena has been observed in water slurries of bio-solids, coal, paper pulp, or shale oil rock.

In a third embodiment, consider the existing gasification process of bituminous coal involving the slurrying of coal with water, then partially oxidized (combusted) with oxygen at the top of a gasifier to provide the heat for the gasification process. Steam is generated as a result of the oxidation process, then the slurry is preheated to vaporize part or all of the remaining water before being blown into the gasifier to achieve the desired steam-to-coal feed ratio. With this invention as an integral part of the gasifier process, the microwave-based fuel vaporizer, with the coal slurry passing through the applicator, produces the steam through dipolar polarization, while also providing the heat necessary for gasification through dielectric polarization of the coal.

In a fourth embodiment, crude oil tankers arrive at refineries, generally located near ports. After pumping their contents into the refineries, a layer of sludge remains on the walls and bottom of the tanker. This sludge slurry is currently scraped and vacuumed into a holding vessel onshore, for solidifying and subsequent disposal into a hazardous material landfill. The invention presented herein heats the crude oil tanker sludge to a temperature of 298° F., which is sufficiently high to produce hydrocarbon gases. These hydrocarbon gases are subsequently recovered as syngas and fuel oil. The applied microwave energy is precisely controlled to maintain the operating temperature at 298° F. to prevent carbonization within the ceramic pipe. The remaining viscous material may be sold to asphalt companies for paving applications.

The system described previously, and illustrated in FIGS. 1 and 2, is a single-fed microwave-based system designed for low flow, low pressure applications, such as the biodiesel application, using one ceramic tube. This system is more application specific for particular liquids and light slurries, and may be tuned to a specific load. FIG. 3 is a schematic diagram of the liquid vaporizer system.

Figure 2:
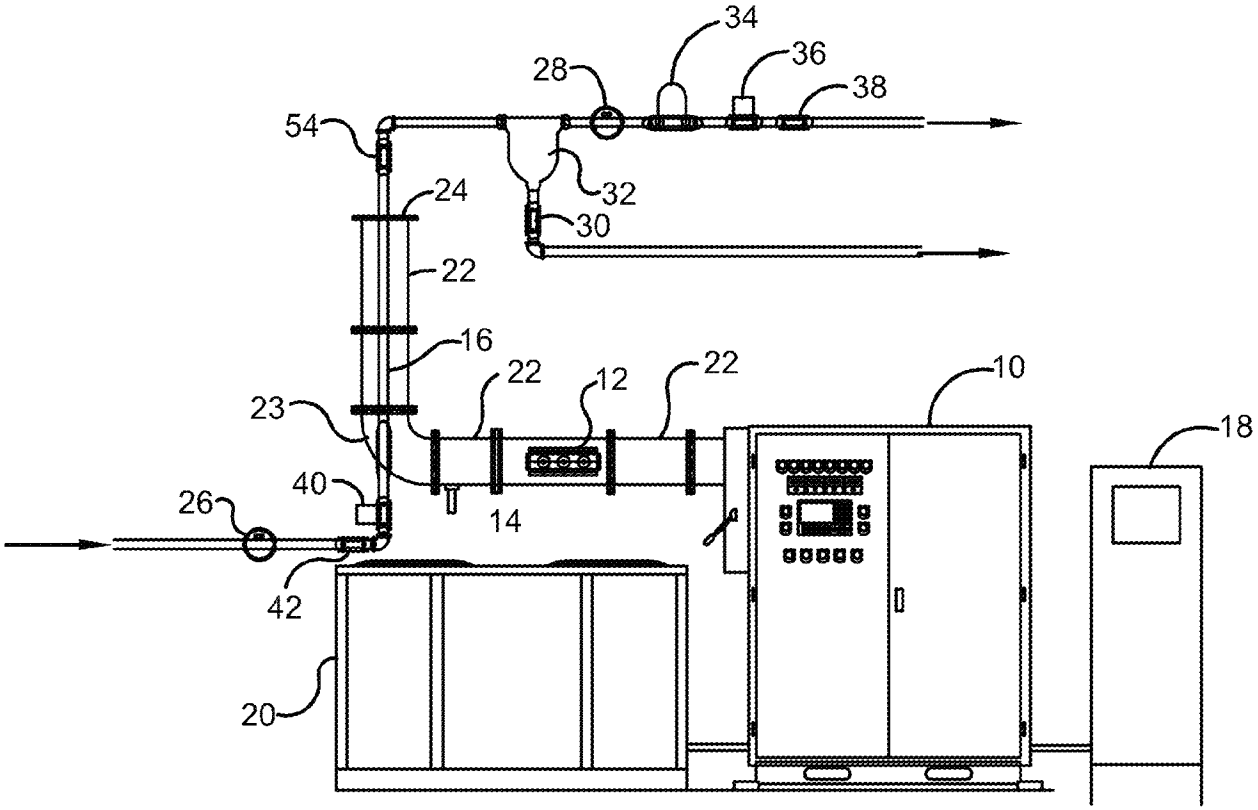
FIG. 2 is a side elevational view of a microwave-based fuel vaporization system.
Figure 3:
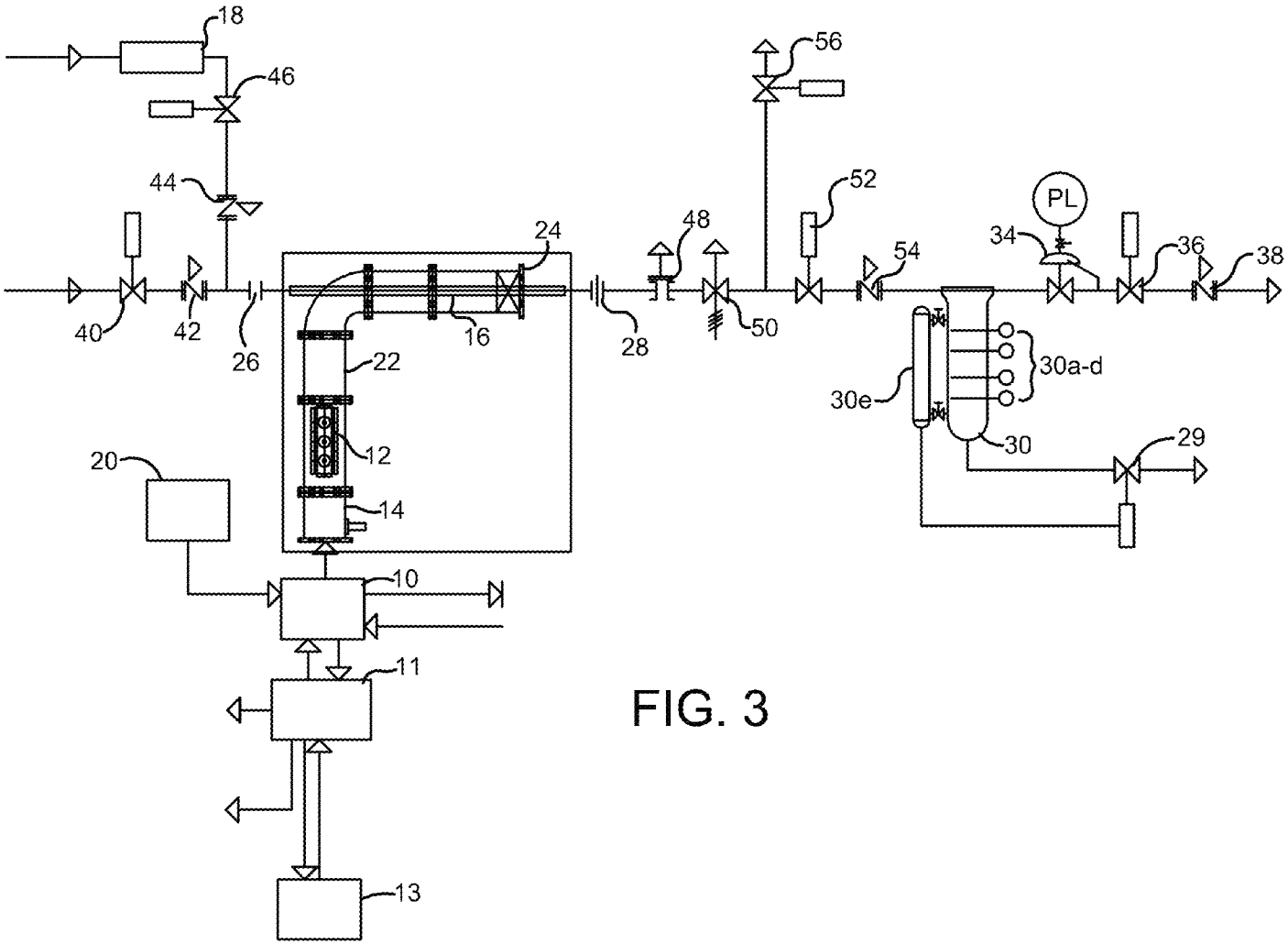
FIG. 3 is a schematic for a microwave-based fuel vaporization system.

As illustrated in FIGS. 1, 2, and 3, microwave energy is produced by microwave generator 10 and coupled through waveguides 22, through 3-stage stub tuner 12 toward dummy load or reflector plate 24 (better illustrated in FIG. 2).

Prior to startup of the system, process isolation valves 38 and 40 remain closed after the preceding shutdown. Nitrogen generator 18 supplies nitrogen through solenoid valve 46 and check valve 44 in a purge and pressurize sequence. With vent valve 56 closed, nitrogen initially pressurizes the system. Upon pressurization, vent valve 56 is opened and nitrogen, along with any displaced air, flows out vent valve 56 until five volumes of purge gas have been completed. Nitrogen continues to flow at a reduced rate to reduce the Btu valve of the recovered gas to levels acceptable to the prime mover. Upon shutdown and after the temperature decreases to less than 100° F., the process isolation valves 38 and 40 are closed.

An essentially transparent ceramic (zirconia, more preferably 99.8% alumina) tube 16 is inserted in the elbow of waveguide 22, which contains the flowing liquid. Arc detector 14 is installed preceding the waveguide elbow to detect excess applied microwave power, resulting in an arc. The arc detection system built into microwave generator 10 will temporarily remove the magnetron anode power for 30 seconds, and attempt to transfer microwave energy into the waveguide 22.

Liquid is supplied through the liquid flow meter 26 through solenoid valve 40 and check valve 42 into ceramic tube 16. The liquid to be processed flows through 1½ inch ceramic tube 16 inserted into waveguide 22, which passes through reflector plate 24. The combined waveguide section 22 from the waveguide elbow to the reflector plate 24 form the applicator. The liquid is exposed to high power density microwave energy as it passes through ceramic tube 16 within waveguide assembly 22. During this time, the process fluid is converted to a mixture of hydrocarbon gases. Upon exiting ceramic tube 16 through solenoid valve 52, check valve 54, and condenser 56, the gaseous mixture enters the separation and recovery process. The condenser reduces the temperature of the process gas from its operating temperature to 75° F.

The heat rejected from the process by condenser 56 and the magnetron losses manifested as heat, are removed by the glycol/water mixture passing through the chiller package 20 and its reservoir. The residence time within the chiller is sufficient to allow operation in a closed loop mode.

The gas/liquid separator 32 separates the condensable liquids from the non-condensable gases. Level switches **30*a*-30*d* control the level within separator 30 and open the separator drain solenoid 28 for the recovered liquid fuels to flow to the liquid fuel storage tank through condensate drain valve 29. The liquid level in the separator can be observed in sight glass 30*e*. The gases exiting separator 30, pressure control valve 34, fuel outlet isolation valve 36, and through check valve 38** to a surge drum located on the prime mover. The prime mover may be a reciprocating engine or gas turbine coupled to an electrical generator for cogeneration within the plant or to the electric utility grid.

The following system, illustrated in FIGS. 4 through 7, contains a dual-fed microwave-based system designed for high flow, high pressure applications, such as heavy crude oil, crude oil, tank/tanker bottom sludge, and bituminous coal slurries, using a dual cross-coupled applicator and four ceramic (preferably 99.8% alumina) tubes 16 to achieve maximum flexibility in processed materials. This invention includes the complete processing plant from separation of the solids from the slurry, processing of the recovered liquids, and extraction of the fuels from the liquids by the microwave-based liquid vaporization system. Illustrated are a pair of microwave generators **10*a*, 10*b* each of which generate microwaves for transport into waveguides 22 and tuner assembly 12. Each waveguide has an "E-plane" 60*b* or "H-plane" 60*a* elbow, for transmission of the microwaves into generally "U-shaped" waveguides 22, each waveguide terminating with reflector plate 24 to create a standing wave. As described previously, tuning assembly 12 enables either manual or automatic microwave tuning. Each essentially parallel leg of the "U-shaped" waveguide further at least partially contains ceramic tube 16, for which ingress and egress is effected at each bend of the waveguide. The alumina tubes are affixed to the waveguides via couplers 62**.

In a preferred embodiment, the complete sludge processing plant is comprised of two skids, including the process skid generator skid, to accommodate transportation and achieve maximum portability.

Figure 4:
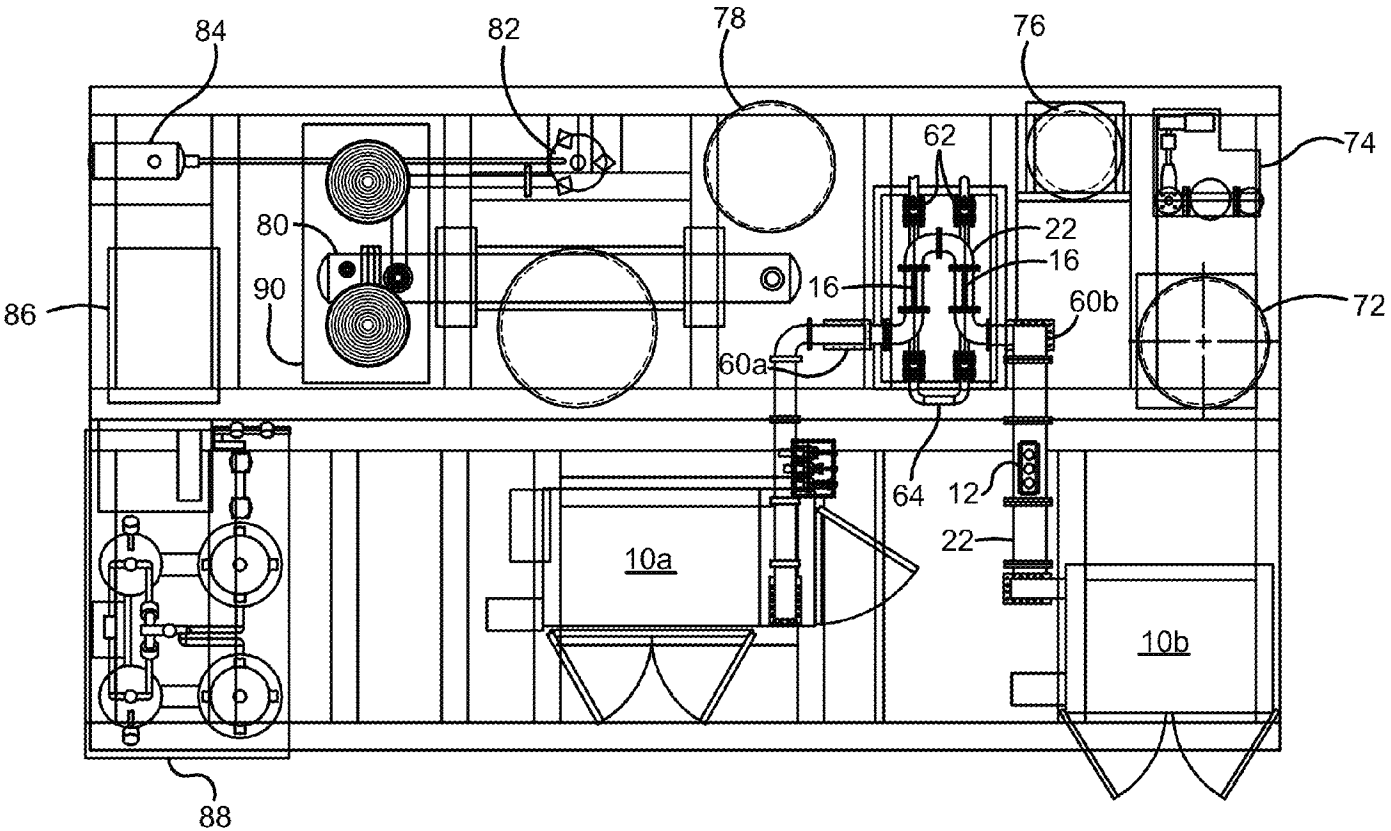
FIG. 4 is a top plan view of a dual-fed microwave-based liquid vaporization system.

FIG. 4 illustrates in the plan view, the details of both the microwave and nitrogen generation skid and the process skid, which provide the foundation for mounting all of the major components.

The lower skid includes microwave generators 10*a* and 10*b* (preferably two 100 kW) with the 3-stage stub tuners 12 and the tuned waveguide assemblies 60*a* and 60*b*, along with the air dryer (not shown) and nitrogen generator 88. Not shown is the glycol/water reservoir which is mounted between microwave generator 10*a* and nitrogen generator 124. The 250-400 gallon glycol/water reservoir provides sufficient retention time for the 10-12 ton chiller 90 to adequately cool the water/glycol mixture from a maximum operating temperature of 752° F. to 75° F., while operating in closed loop mode.

The upper skid contains centrifuge 72, centrifuge feed pump (not shown), and two heaters (also not shown). In addition, the upper skid includes inlet buffer feed pump assembly 74, inlet buffer tank 76, gas particulate tank 78, process gas condenser 80, gas/liquid separator 82, liquid fuel storage tank 92 and its pump (not shown), process gas compressor 84, feedgas air compressor 86 for the air dryer and nitrogen generator 88.

The upper skid also contains the pressurized cross-coupled applicator assembly 122, which includes straight waveguide sections 22, ceramic tubes 16, aluminum horizontal return pipe assembly 64, and the special sealed flange assembly 62. Further details related to the applicator 122 will be presented in the discussion of FIGS. 5, 6, 7 & 9.

Figure 5:
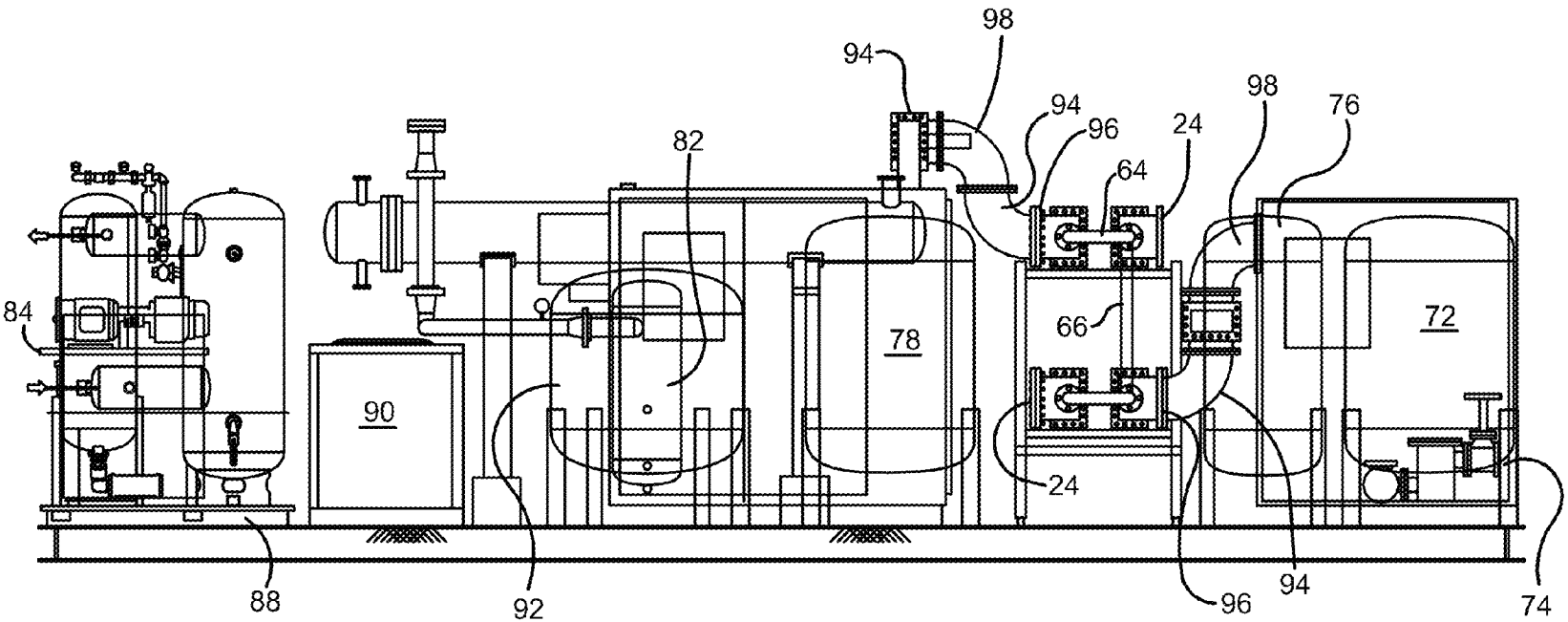
FIG. 5 is a side elevation view of a dual-fed microwave-based liquid vaporization system.

FIG. 5 illustrates in the elevation view, the details of both the microwave and nitrogen generation skid and the process skid, which provide the foundation for mounting all of the major components.

Further details of pressurized cross-coupled applicator assembly 122 are provided in this view (illustrated better with reference to FIG. 6), including the horizontal aluminum return pipe assembly 64, vertical aluminum return pipe assembly 66, reflector plate or dummy load 24, dual fused quartz vapor barrier 96, E-plane waveguide elbows with flanged choke tube provisions 98, H-plane waveguide elbows 94, along with all of the other major components described in FIG. 4.

Figure 6:
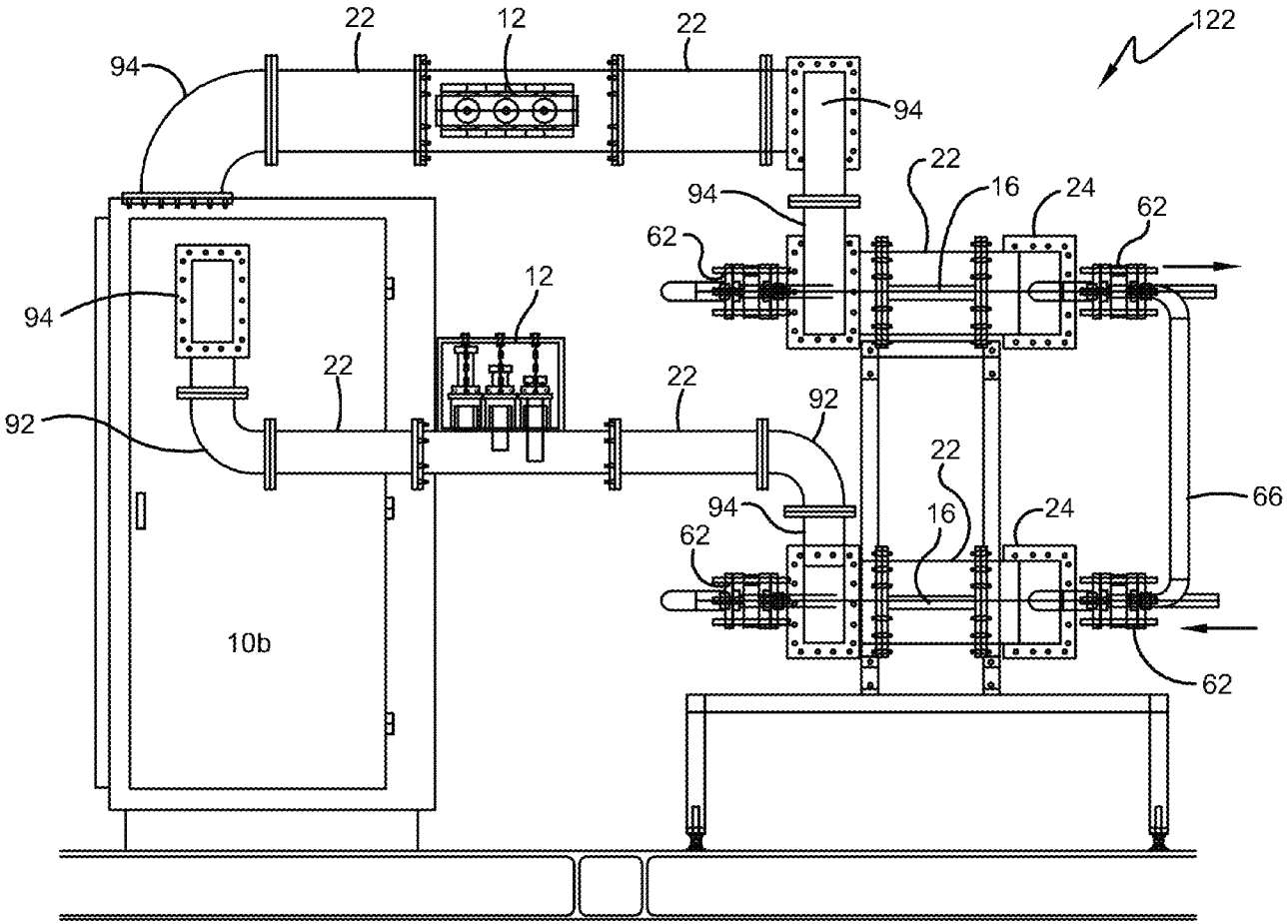
FIG. 6 is a side elevational view of the microwave generator, waveguide, and applicator assembly for a dual-fed microwave-based liquid vaporization system.

FIG. 6 illustrates a cross-sectional elevation view of the pressurized cross-coupled applicator assembly 122, along with the input waveguide configuration from the microwave generators 10*a* and 10*b*, 3-stage stub tuners 12, straight waveguide sections 22, E-plane waveguide elbows 92, and H-plane elbows 94 mounted on a common skid. This figure further illustrates the component alignment, symmetry, and placement of the straight waveguide sections 22, E-plane waveguide elbows 92, and H-plane elbows 94, ceramic tubes 16, reflector plates 24, and the special sealed flange assembly 62 within the assembled applicator and mounted on its support frame.

Figure 7:
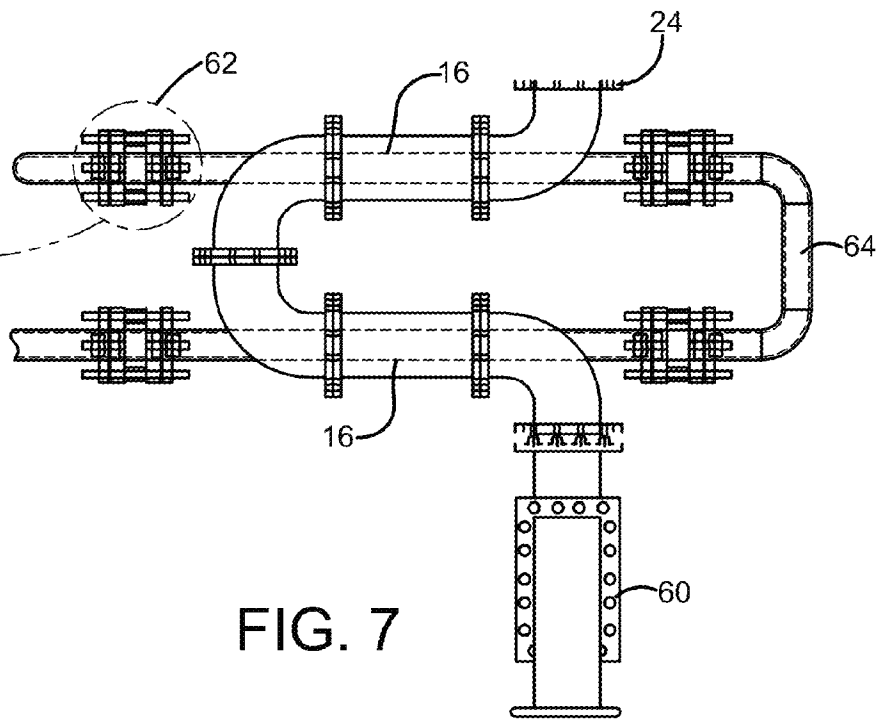
FIG. 7 is a top plan view detail of the waveguide and applicator for one-half of a dual-fed microwave-based liquid vaporization system.
Figure 7A:
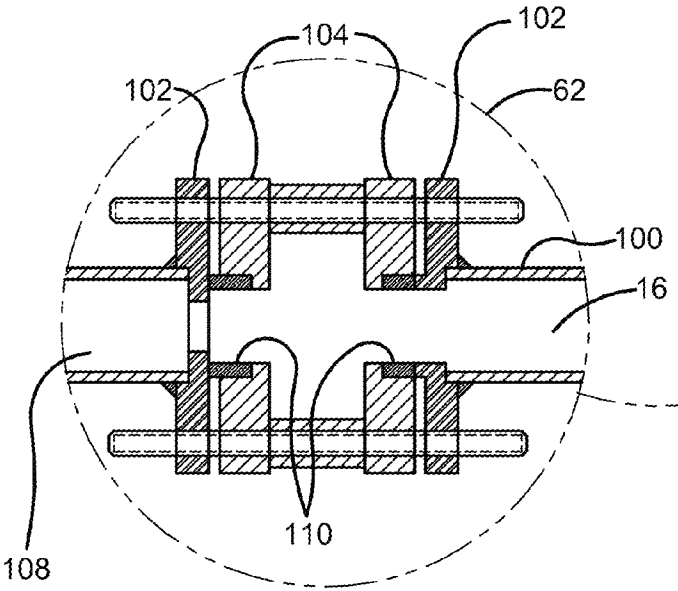
FIG. 7*a* is an exploded view of one of the couplers illustrated in FIG. 7.

FIG. 7 provides a plan view of the applicator assembly 122 for one-half of the dual-fed, cross-coupled applicator, while FIG. 7*a* provides the assembly details for one of the special dual seal flanged assembly or coupler 62. As illustrated in FIG. 7, microwave input waveguide assembly 60, dual fused quartz vapor barrier 96, E-plane waveguide elbows with flanged choke tube provisions 98, ceramic tubes 16, reflector plates 24, horizontal aluminum return pipe assembly 64, and the special dual seal flanged assembly or coupler 62 for the bottom one-half of the applicator assembly are illustrated in side elevational view. The top one-half of the applicator assembly is identical and symmetrical, and joined by the vertical aluminum return pipe assembly 66.

The details of one of the couplers 62 shown in FIG. 7*a* which illustrates the sealing methods employed to prevent leakage of both process gas and microwave energy, while providing compensation for thermal expansion within the coupler assembly 62. The coupler assembly detail includes ceramic tube 16, aluminum tube 100, aluminum compression flanges 102, aluminum flanges 104, carbon fiber gaskets 110, aluminum spacers 106, and aluminum pipe 108.

Figure 8:
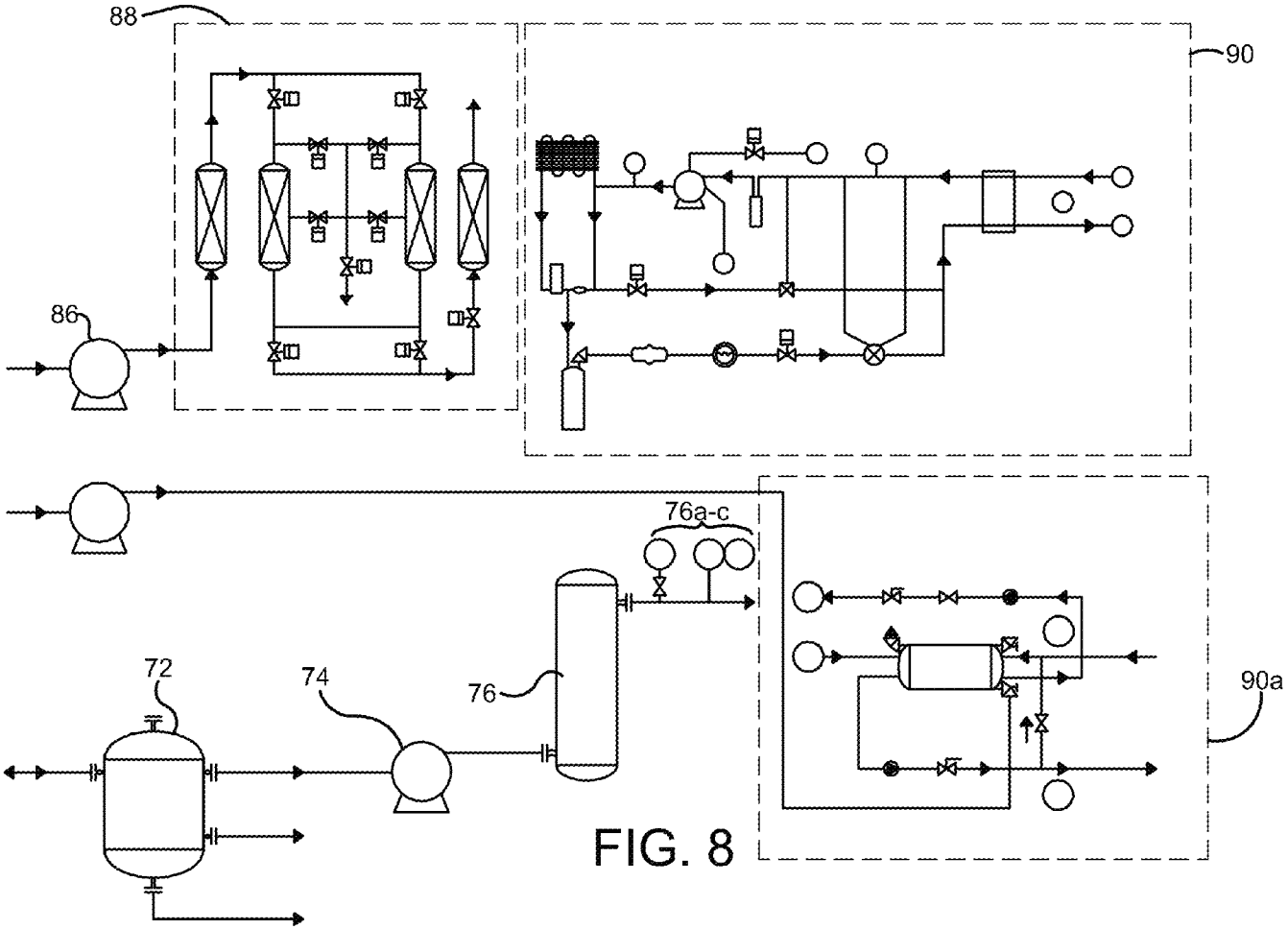
FIG. 8 is a schematic for the centrifuge system, chiller, and glycol/water reservoir included in the dual-fed microwave-based liquid vaporization system.
Figure 10:
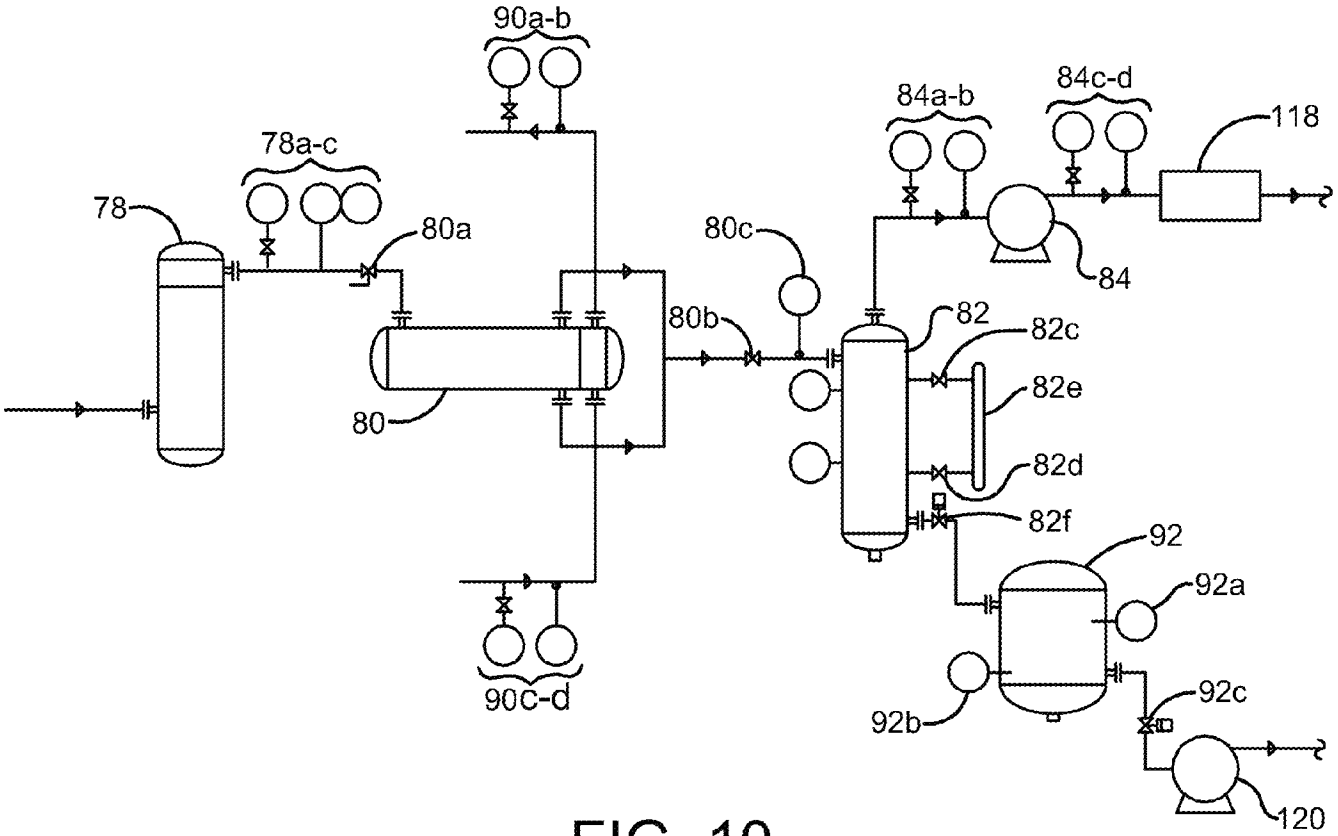
FIG. 10 is a schematic for the process equipment included in the dual-fed microwave-based liquid vaporization system.

The complete microwave-based liquid vaporization plant with its separation, recovery, and extraction methods are given schematically in FIGS. 8 and 10. Generally, these drawings comprise a piping and instrumentation diagram (P&ID) as is known in this petrochemical industry.

Figure 9:
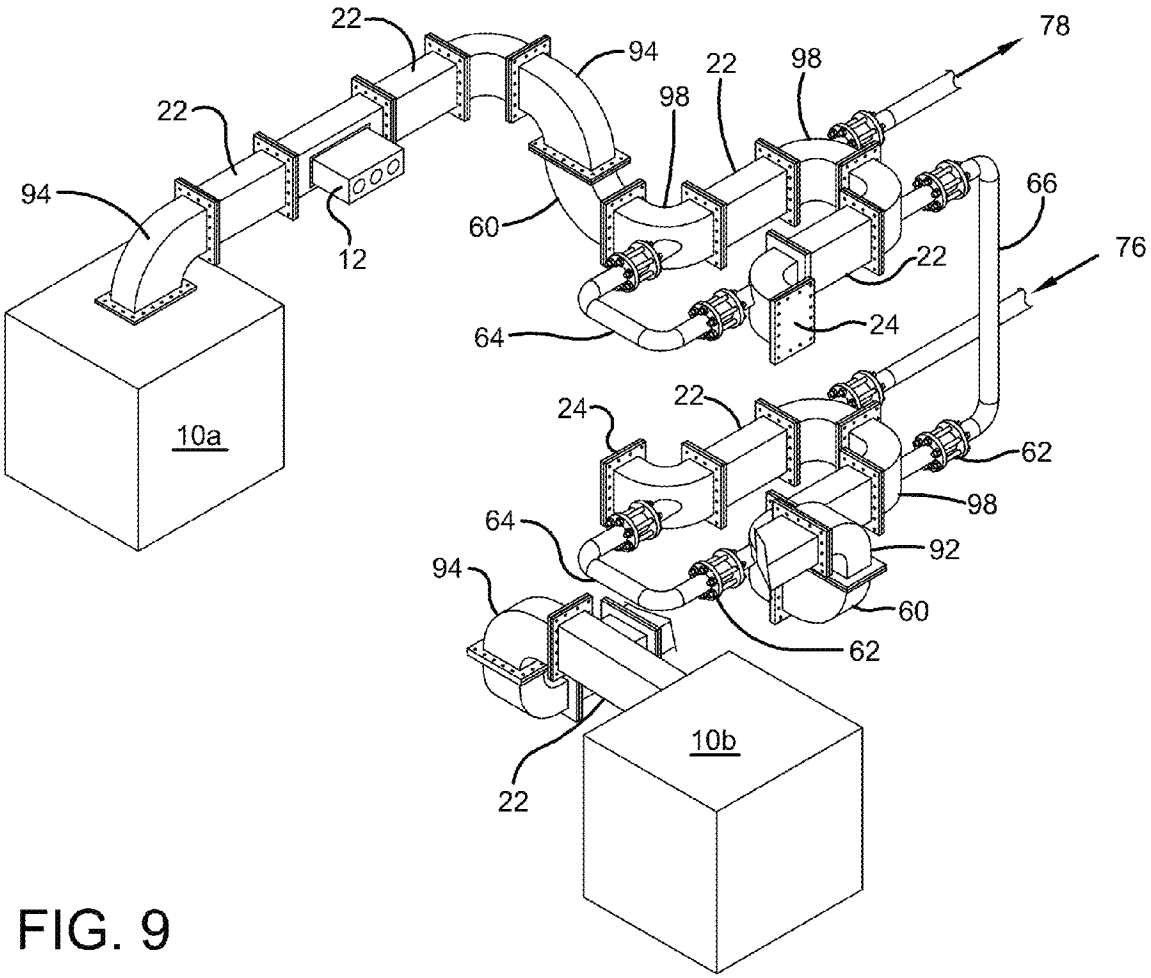
FIG. 9 is a schematic for the microwave generators, tuned waveguide assembly, and applicator with ceramic tubes included in the dual-fed microwave-based liquid vaporization system illustrating the vertically spaced apart waveguides and ceramic tube positioned at least partway through parallel legs of the waveguide assembly.

FIG. 9 is a diagrammatic representation of an isometric view of the pressurized cross-coupled applicator assembly 122 and illustrates the configuration of components included in the microwave reduction section, specific parts of which were previously addressed relative to FIGS. 6 & 7.

The inputs from microwave generators 10*a* and 10*b* are propagated through their respective waveguides components, 3-stage stub tuners 12, and into the applicator assembly 122. The configuration of the waveguide components between the microwave generator and the applicator is referred to as a tuned waveguide assembly, and identified as 60*a* and 60*b*.

The term pressurized cross-coupled applicator assembly is derived from the sense that two generators 10*a* and 10*b* propagate microwave energy simultaneously toward their respective reflector plates. The pressurized fluid flowing through the ceramic tubes 16, which are constructed of extruded alumina 99.8% by for their mechanical strength, dielectric, and thermal properties, along with their microwave transparency at the operating temperatures, absorbs all of the microwave power presented. The pressurized fluid is exposed almost instantaneously to the high power density microwave energy four times during one periodic waveform generated by only two microwave sources. This method of exposure and to absorption of the microwave energy, results in a significant improvement in process heating efficiency, considering that the period of one waveform of microwave energy occurs in only 1.08 nanoseconds. This method of microwave application and absorption by continuously flowing pressurized liquids, along with the uniqueness of the applicator 122 design, is one of the innovative aspects of the design and process.

It is through application of high power density microwave energy applied through the walls of the microwave-transparent ceramic tubes 16, and direct absorption of the microwave energy by the liquids flowing through the ceramic tubes 16, that reduction of the liquids occurs. Microwave reduction occurs at the molecular level, resulting in reduction of molecular size changes in molecular composition. Subsequently, reduction in viscosity occurs, allowing recovery of commodity fuels from the previously discarded sludge. Applicator assembly 122 receives liquids from in-feed buffer tank 76 and outputs hydrocarbon vapors into gas particulate tank 78.

FIG. 8 provides a schematic diagram of the air compressor 86, air-dryer, nitrogen generator 88, chiller 90, and glycol/water recirculation tank. FIG. 8 also presents the process from the sludge input to the applicator 122 input. The sludge is pumped by a positive displacement pump, through two 18 kW heaters connected in series, and into disk centrifuge 72. This 1,000 g disk centrifuge separates the sludge into three phases: oil, water, and solids. The oil is pumped by positive displacement pump 74, which is controlled by a variable frequency drive, into in-feed buffer tank 76 for intermediate storage. Pressure, temperature, and flow of the liquid exiting the in-feed buffer tank is monitored by their respective transmitters 76*a-c*, respectively, whose outputs are communicated to the PLC located in the microwave generator 10*a* control panel. The pressurized liquid continues to flow to the microwave applicator 122. Through absorption of applied microwave energy, the pressurized process liquid is converted to a mixture of hydrocarbon gases.

FIG. 10 provides a schematic diagram of the gas processing subsequent to exiting the applicator 122. To prevent overpressure, rupture disk 112 and pressure-regulating or safety relief valve 114 are installed in the piping downstream of applicator 122 exit. A vent valve is also installed to provide a method for nitrogen a purge and pressurize sequence during startup. Isolation valve 118 is installed to isolate the gas process from the applicator and liquid processing sections.

Hydrocarbon gas mixture flows through the hydrocarbon gas particulate tank 78 containing a fine mesh screen to remove any carbon, soot, or any other fine particles. Gas mixture pressure, temperature, and flow exiting gas particulate tank 78 is monitored by their respective transmitters 78*a-c*, respectively, whose outputs are communicated to the PLC located in the microwave generator 10*a* control panel.

The hydrocarbon gas mixture continues to flow through a condenser isolation valve 80*a* into the condenser. After passing through condenser 80, the gas mixture is cooled from process temperature of 752° F. to 75° F. The condenser output flows through isolation valve 80*b*, and through the gas/liquid separator 82.

Gas/liquid separator 82 is a vortex type, developing sufficient centrifugal force to cause the condensable products to impinge against the baffles and wall, and drain to the bottom, while the non-condensable gas mixture flows out the top. The input temperature is monitored by temperature transmitter 80*c*. The high and low levels of the condensed liquids are monitored by level switches 82*a-b*, respectively.

The level may be observed in sight glass 82*e*, isolated by isolation valves 82*c* and 82*d*. The liquid is drained by energizing solenoid valve 82*f* and liquid fuel flows into the liquid fuel storage tank 92. After the liquid fuel has drained down to the lower level set-point monitored by level switch 82*b*, solenoid valve 82*f* is de-energized. The high and low levels in the liquid fuel storage tank are monitored by level switches 92*a-b*, respectively.

Upon reaching the upper level set-point, monitored by level switch 92*a*, solenoid valve 92*c* is energized and the liquid is removed by pump 120. After the liquid fuel has drained down to the lower level setpoint monitored by level switch 92*b*, solenoid valve 92*c* is de-energized, and the pump is turned off.

The gas mixture exiting gas/liquid separator 82, which is at the suction side of the process gas compressor, is monitored by pressure and temperature transmitters 84*a-b*, respectively. The gas is compressed by a positive displacement compressor 84, which is controlled by a variable frequency drive, whose operating setpoint is controlled by pressure and temperature transmitters, 84*c-d*, respectively. The pressure and temperature transmitter outputs, 84*c-d*, respectively, are communicated to the PLC located in the microwave generator 10*a* control panel.

Flame arrestor 118 is located after the process gas compressor to prevent air from entering the gas stream from an outside source. Isolation valve 116 is installed in the output piping to provide complete isolation from any other process or plant. The recovered gas mixture may be sent to a prime mover connected to a generator for generation of electricity within the plant or cogenerating with the electrical utility Microwave System Components:

Microwave Generators: Two microwave generators operating at 915 MHz, with a continuously-variable power output of 0-100 kW in a constant efficiency mode, each couple their microwave energy output into a tuned WR-975 waveguide assembly.

Power Density Monitoring: Power density monitors are installed in each microwave generator to monitor the applied power to the applicator and the reflected power from the applicator by a pair of sampling diodes installed within a directional coupler mounted in the waveguide.

Waveguide Sections: The waveguide selected is WR-975, fabricated from ⅛" wrought aluminum, Type 6061-T6. This material provides the necessary strength, durability, corrosion resistance, and electrical conductivity for this application. Each waveguide assembly includes a multi-stage stub tuner assembly to provide a constant load impedance to the generator.

Stub Tuners: A manually tuned, three-stage tuner assembly is used to match the output impedance of the microwave generator to the material flowing through the ceramic tubes in the applicator assembly. The stub tuner consists of a WR-975 waveguide section, one wavelength long, with three brass tuning screws. Each brass tuning screw is separated from the other by a distance of ⅛ wavelength. The tuning screws labeled 1, 2, and 3 in the direction from the microwave generator toward the applicator presents a change in capacitance and thereby, susceptance to the microwave waveform. The tuning assembly is inserted into the narrow wall of the WR-975 waveguide for tuning up to ¼ wavelength across the broad wall. The ¼ wavelength insures the effect is only capacitive, as adjustments beyond ¼ wavelength would produce an inductive effect. Adjustment of the tuning screws is made and observing the effect on a network analyzer. Adjusting tuning screws 1 and 2 moves reduces the microwave output power from the generator to the load. Adjusting tuning screws 2 and 3 increases the microwave output power from the generator to the load. Essentially, adjustment of the tuning screws provides a phase shift in the microwave output waveform to allow maximum absorption of the forward power, with minimum reflected power, thereby transferring maximum power from the microwave generator to the load at all times. Forward and reflected power may be measured across the sampling diodes in the directional coupler.

Process Components:

Centrifuge Feed Pump Assembly: The centrifuge feed pump assembly provides the pressure to pump the crude oil from an oil well or crude oil sludge from a storage tank or vessel to the centrifuge infeed heaters and subsequently to the centrifuge.

Centrifuge In-feed Heaters: Two 18 kW centrifuge in-feed heaters raise the operating temperature of the incoming sludge to 200° F. in order to enhance centrifugal separation of the solid and liquid phases of the materials contained within the slurry.

Centrifuge Assembly: This process uses a rotating disk centrifuge, which develops more than 1000 g's to break the cohesive emulsion interface between the solids and liquids suspended in a slurry. Solids, water, and crude oil are separated simultaneously from the slurry by centrifugal force and ejected independently into their respective holding tanks.

Inlet Buffer Pump Assembly: The inlet buffer pump assembly pumps the crude oil from the centrifuge crude oil holding tank into the inlet buffer tank for storage.

Inlet Buffer Tank: The inlet buffer tank provides intermediate storage of the crude oil for processing by the microwave-based liquid vaporization system.

Rupture Disk: The rupture disk is an overpressure safety device to avoid excess pressure to the microwave applicator. The rupture disk is set to fail at 10% above normal applicator operating pressure of 25 psig.

Safety Relief/Vent Valve: The safety relief/vent valve is set to open at 15% above normal applicator pressure of 25 psig. The vent valve also serves to open and close during the purge and pressurize cycles during startup of the process.

Applicator: The applicator is a dual-fed, cross-coupled device capable containing alumina tubes through which the heavy crude oil flows. The ceramic tubes contained within the waveguide through which the microwave energy is applied. The ceramic tubes are transparent to applied microwave energy, leading to direct absorption by the material as it flows through the tubes. Since the tubes are constructed of a low-loss material, no energy is wasted heating the tubes, then depending on heat transfer characteristics to heat the material, as in conventional processes. The direct absorption of high power density microwave energy reduces the asphaltenes and waxes, which produces a correspondingly lower viscosity, leading to relatively lighter liquid fuels such as fuel oil and diesel. The net result is a significant energy savings, contributing to higher process efficiency.

Gas Particulate Tank: The gas particulate tank contains a fine mesh screen to trap any particles suspended in the flowing gas stream, thus preventing the particles from forming deposits within the condenser on the tubes.

Condenser: The condenser is a cross-flow shell-and-tube heat exchanger which serves as a single-point distillation column to reduce the temperature of the hydrocarbon gas stream from 752° F. to 75° F. into two phases. This results in the formation of both gaseous (non-condensable) and liquid (condensable) components or byproducts.

Gas/Liquid Separator: The gas/liquid separator operates on centrifugal principles. The hydrocarbon stream from the condenser is directly into a vessel, whose entry point is off-center, leading to rotation of the inlet stream. Baffles within the separator direct the gaseous mixture to flow out the top, while centrifugal action forces the liquids against the walls, allowing a gravity-fed oil stream to drain toward the bottom of the separator.

Liquid Fuel Storage Tank: The liquid fuel storage tank accumulates the liquid output from the separator.

Process Gas Compressor: This process gas compressor creates a positive hydrocarbon gas flow from the gaseous output of the separator toward the process output for use in a prime mover, such as an engine-generator or gas turbine for electrical production in cogeneration mode within the plant or with a local utility. In the event of a process upset, the gas may be vented to atmosphere.

Flame Arrestor: The flame arrestor is at the end of the gas process line to prevent air from traveling in the reverse direction from atmosphere toward the process gas, resulting in combustion or explosion.

Ancillary System Components:

Air Compressor: The air compressor develops 150 psia from atmospheric air pressure and provides the pressurized air to as feed gas to the nitrogen generator.

Nitrogen Generator: The nitrogen generator is a pressure swing absorption (PSA) unit capable of high pressures and high flows. In contrast, the nitrogen generator used on the single-fed microwave-based vaporization system is a membrane type since only low flows and pressures are required.

Chiller: The chiller is used to remove the heat developed by the magnetrons, which is typically approximately 6-8% of full power or 2049-2732 Btu/hour. In addition, the chiller removes the heat rejected by the process condenser.

Water/Glycol Reservoir: The water/glycol reservoir is size with sufficient retention time to permit operation in closed-loop mode. In other words, the reservoir is only filled initially with a 50/50 mixture of water and ethylene glycol and operates continuously on that fluid. Other heat transfer fluids may be alternately be used such as commercially-available organic heat transfer fluids.

System Control Components:

PLC: The Programmable Logic Controller (PLC) is programmed for startup, operation, shutdown, and emergency shutdown sequences, as well as process monitoring, data logging, and report generation.

Gas Flow Meter: The gas flow meter is a pitot type sensor, converting gas velocity to flow and pressure. Temperature compensation is provided by a chromel-alumel (Type K) thermocouple for accurate indications of mass flow. The meter generates an output of 4-20 mA DC, whose control signal is proportional to the mass flow. This control signal serves as the bias for a variable frequency drive (VFD) operating the input buffer feed pump.

Variable Frequency Drive—Process Gas Compressor: The variable frequency drive (VFD) provides the voltage to the drive motor for the process gas compressor, which is proportional to the drive motor's speed. As the process gas compressor is a positive-displacement type, the flow is directly proportional to the compressor speed. As the flow increases, compressor must be able to remove the flowing hydrocarbon gases to maintain a constant system pressure, thus avoiding over pressurizing the microwave ceramic tubes.

Liquid Flow Meter: The liquid flow meter is a magnetic type sensor, converting changes in magnetic field to flow and pressure. Temperature compensation is provided by a chromel-alumel (Type K) thermocouple for accurate indications of mass flow. The meter generates an output of 4-20 mA DC, whose control signal is proportional to the mass flow. This control signal serves as the bias for a variable frequency drive (VFD) operating the input buffer feed pump.

Variable Frequency Drive—Inlet Buffer Feed Pump: This variable frequency drive (VFD) provides the voltage to the drive motor for the inlet buffer feed pump, which is proportional to the drive motor's speed. As the pump is a positive-displacement type, the flow is directly proportional to the pump speed. As the flow increases, the microwave system must be able to convert the flowing liquids to hydrocarbon gases at the rate of flow provided by the inlet buffer feed pump.

System Control Methods:

Sensors and their corresponding transmitters generate outputs of 4-20 mA DC proportional to process gas flow, liquid flow, level, pressure and temperature conditions. These transmitter signals are connected to the PLC for metering, sequencing and control. Coupled with control logic, sequences such as startup, operation, shutdown, and emergency shutdown are maintained in PLC software, backed up by non-volatile memory, such as EEPROM.

Further, the PLC communicates over an Ethernet bus, which permits remote interrogation of the process plant for effecting diagnostics, troubleshooting and repair. One can also remotely ascertain the current plant operating conditions. The PLC's Ethernet bus allows communication with the plant in real time.

Finally, security can be insured through on-site cameras monitoring particular sensitive areas, such as the process area, fuel storage area, and control room for any abnormal operating conditions.

The best mode for carrying out the invention has been described for the purposes of illustrating the best mode known to the applicant at the time. The examples are illustrative only and not meant to limit the invention, as measured by the scope and spirit of the claims. The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof.

The invention claimed is:

1. An apparatus which comprises:

at least one microwave generator;

at least one generally rectangular waveguide having a standing microwave of approximately 915MHz therein generated by said microwave generator; and an essentially microwave-transparent ceramic tube having an inlet and an outlet, said ceramic tube positioned at least partially within said waveguide and exposed to said standing wave;

a pump to move a liquid organic-containing material into said essentially microwave-transparent ceramic tube inlet;

a microwave frequency adjustment tuner assembly to match output impedance of said microwave generator to said liquid organic-containing material flowing through said microwave-transparent ceramic tube; and a power density monitor for measuring applied and reflected power within said at least one essentially rectangular waveguide by at least one sampling diode within a directional coupler mounted in said at least one waveguide, said power density monitor providing feedback to minimize reflected power by adjustment of said microwave frequency tuner.

2. The apparatus of claim 1 wherein said at least one rectangular waveguide further comprises a pair of two generally U-shaped rectangular waveguides in spaced vertical relationship, each pair of two generally U-shaped rectangular waveguides having two essentially parallel segments with a first and a second end, and one base segment connecting each of said second ends of said parallel segments to each other, each of said pair of two generally U-shaped rectangular waveguides terminating with a reflector plate.

3. The apparatus of claim 2 wherein said microwave-transparent ceramic tube is positioned at least partially within each of said two essentially parallel segments of each of said pair of waveguides.

4. The apparatus of claim 2 wherein said inlet of said microwave-transparent ceramic tube enters proximate one end of one of said parallel segments of a first waveguide and exits through one other end of the other parallel segment of said second rectangular waveguide, and a longitudinal axis of said microwave-transparent ceramic tube parallel to a longitudinal axis of each parallel segments of said first and second waveguides.

5. The apparatus of claim 4 wherein said microwave-transparent ceramic tube comprises several linear ceramic tubes positioned within at least a portion of said waveguides and comprises connecting metallic tubes outside of said waveguides, and which follows the following path:

enters proximate a second end of said first waveguide and extends through said parallel segment and exits a first end of said parallel segment;

enters said first end of an opposed parallel segment of said first waveguide and extends through said opposed parallel segment and exits proximate the second end of said first waveguide;

enters proximate a second end of said second waveguide and extends through said parallel segment and exits a first end of said parallel segment;

enters said first end of an opposed parallel segment of said second waveguide and extends through said opposed parallel segment and exits proximate the second end of said second waveguide.

6. The apparatus of claim 2 wherein each of said first and second waveguides further comprise:

a microwave frequency adjustment tuner assembly.

7. The apparatus of claim 1 wherein said microwave tuner is 3-stage tuner assembly.

8. The apparatus of claim 7 wherein said 3-stage tuner comprises a one wavelength long waveguide section and three brass tuning screws, each brass tuning screw separated by a distance of ⅛ wavelength.

9. The apparatus of claim 1 wherein said microwave-transparent ceramic tube is constructed from the group consisting of alumina and zirconia.

10. A process to excite liquid-containing organic material comprising the steps of:

creating a standing microwave within at least one essentially rectangular waveguide;

pumping said liquid-containing organic material through at least one essentially microwave-transparent ceramic tube which extends at least partially into said at least one essentially rectangular waveguide;

exposing said material to said microwave;

monitoring applied and reflected power within said at least one essentially rectangular waveguide by at least one sampling diode within a directional coupler mounted in said waveguide;

tuning said standing microwave by adjusting a frequency of said standing microwave by means of a tuner assembly which matches output impedance of said standing microwave to said liquid-containing organic material flowing through said ceramic tube, comparing applied and reflected power using a power density monitor to minimize reflected power of said microwave with said liquid-containing organic material by adjustment of said frequency of said standing microwave in said step of tuning; and collecting by-products created therefrom.

11. The process of claim 10 wherein said tuning is automatic using a 3-stage tuner comprising a one wavelength long waveguide section and three tuning screws, each tuning screw separated by a distance of ⅛ wavelength.

12. The process of claim 10 wherein said process of creating said standing microwave occurs in two separate waveguides, each of said waveguides having at least one ceramic tube at least partially embedded therethrough.

13. The process of claim 10 wherein a frequency of said standing microwave is approximately 915 MHz.

14. The process of claim 10 wherein said liquid-containing organic material is heavy crude oil and said excitation process results in a lowered viscosity crude oil comprising fuel oil and diesel oil.

15. The process of claim 10 which further comprises:

creating two standing microwaves within two essentially rectangular U-shaped waveguides;

pumping said liquid-containing organic material through an essentially microwave-transparent ceramic tube which extends at least partially into each of said essentially parallel sides of said rectangular waveguides.

16. The process of claim 15 wherein said step of pumping results in travel of said liquid-containing organic material within said essentially microwave-transparent linear ceramic tubes and through both pairs of essentially parallel sides of said rectangular waveguides, said liquid-containing organic material passing through metallic tubes when transporting said material between said parallel sides of said rectangular waveguides.

17. The process of claim 10 which further comprises the step of:

monitoring power density within each microwave generator to monitor the applied power to an applicator and the reflected power from said applicator by a pair of sampling diodes installed within a directional coupler mounted in the waveguide.

* * * * *